US010403245B1

(12) United States Patent
Flynn

(10) Patent No.: US 10,403,245 B1
(45) Date of Patent: Sep. 3, 2019

(54) MUSICAL INSTRUMENT SLIDE AND METHOD OF MANUFACTURE

(71) Applicant: Michael Flynn, Evanston, IL (US)

(72) Inventor: Michael Flynn, Evanston, IL (US)

( * ) Notice: Subject to any disclaimer, the term of this patent is extended or adjusted under 35 U.S.C. 154(b) by 0 days.

(21) Appl. No.: 16/168,640

(22) Filed: Oct. 23, 2018

(51) Int. Cl.

| | |
|---|---|
| ***G10D 3/00*** | (2006.01) |
| ***G10D 3/10*** | (2006.01) |
| ***G10D 1/00*** | (2006.01) |
| ***G10D 1/08*** | (2006.01) |

(52) U.S. Cl.
CPC ..... *G10D 3/10* (2013.01); *G10D 1/005* (2013.01); *G10D 1/085* (2013.01); *G10D 3/00* (2013.01)

(58) Field of Classification Search
CPC ..... G10D 3/00; G10D 3/10
See application file for complete search history.

(56) References Cited

U.S. PATENT DOCUMENTS 1,372,254 A * 3/1921 Shutt ..... G10D 3/00 84/319
1,618,884 A * 2/1927 Meyer ..... G10D 3/00 84/319
1,748,053 A * 2/1930 Blair ..... G10D 3/00 84/319
1,834,252 A * 12/1931 Morgan ..... G10D 3/00 84/319
1,904,335 A * 4/1933 Stevens ..... G10D 3/00 84/319
2,026,354 A * 12/1935 Mihalek ..... G10D 3/00 84/319
2,184,733 A * 12/1939 Burgien ..... G10D 3/00 24/545
2,248,542 A * 7/1941 McDaniel ..... G10D 3/00 84/319
2,435,512 A * 2/1948 Richmond ..... G10D 3/00 84/319
2,449,032 A * 9/1948 Yates ..... G10D 3/00 84/319
2,466,344 A * 4/1949 Wright ..... G10D 3/00 84/319
2,490,517 A * 12/1949 Garcia ..... G10D 3/00 84/319
2,490,865 A * 12/1949 Engles ..... G10D 3/00 84/319
2,496,191 A * 1/1950 Zipperstein ..... G10D 3/00 84/318

(Continued)

*Primary Examiner* — Robert W Horn
(74) *Attorney, Agent, or Firm* — Steven M. Shape; Dennemeyer & Associates, LLC

(57) ABSTRACT

A musical instrument slide for a stringed instrument and a method of manufacturing the same includes a slide body defining an outer wall, the outer wall configured to affect sound produced by the instrument when applied to one or more strings of the instrument. The slide includes an insert within the slide body defining an inner wall and creating a space between the slide body and the insert and further includes liquid within the space between the slide body and the insert to further affect the sound produced by the instrument when the outer wall is applied to the strings. A removable collar may be included with an aperture or opening that may vary in size to accommodate multiple users. Liquid may be selectively sealed between the slide body and the insert and be changed as required.

20 Claims, 10 Drawing Sheets

(56) References Cited

U.S. PATENT DOCUMENTS 2,650,513 A * 9/1953 Miller ..... G10D 3/00 84/319
3,386,325 A * 6/1968 Smith ..... G10D 3/00 84/315
3,638,525 A * 2/1972 Sciurba ..... G10D 3/00 84/319
3,741,065 A * 6/1973 Harris ..... G10D 3/00 84/319
3,854,368 A * 12/1974 Pogan ..... G10D 3/00 84/319
4,092,894 A * 6/1978 Clough, Jr. ..... G10D 3/00 84/319
4,817,488 A * 4/1989 de los Santos ..... G10D 3/00 84/319
4,969,382 A * 11/1990 Hein, III ..... G10D 3/00 84/319
5,251,527 A * 10/1993 Roberts ..... G10D 3/00 84/319
5,450,778 A * 9/1995 Roberts ..... G10D 3/00 84/319
5,458,036 A * 10/1995 Monaco ..... G10D 3/00 84/319
5,492,046 A * 2/1996 Jimenez ..... G10D 3/00 84/319
5,515,762 A * 5/1996 Perkins ..... G10D 3/00 84/315
5,553,527 A * 9/1996 Harrison ..... G10D 3/00 205/662
5,981,856 A * 11/1999 Story ..... G10D 3/00 84/319
6,111,177 A * 8/2000 Pattillo ..... G10D 3/00 84/315
D434,065 S * 11/2000 Morse ..... D17/20
6,160,212 A * 12/2000 Morse ..... G10D 3/00 84/315
6,242,676 B1 * 6/2001 Romero ..... G10D 3/00 84/315
7,476,792 B1 * 1/2009 Musser ..... G10D 3/00 84/315
D662,127 S * 6/2012 Jenkins ..... D17/20
8,269,084 B2 * 9/2012 Ludwig ..... G10D 3/043 84/315
8,399,753 B2 * 3/2013 Coleman ..... G10D 3/00 84/315
8,618,391 B1 * 12/2013 Roberts ..... G10D 3/00 84/315
9,000,283 B1 * 4/2015 Roberts ..... G10D 3/00 84/298
9,105,257 B2 * 8/2015 Shamchuk ..... G10D 1/08
9,251,767 B1 * 2/2016 Shaw ..... G10D 3/00
9,255,815 B2 * 2/2016 Maldonado ..... G01D 3/00
9,437,174 B2 * 9/2016 Shamchuk ..... G10D 3/00
9,892,653 B1 * 2/2018 Hansen ..... G09B 15/06
2012/0297955 A1 * 11/2012 Shook ..... G10D 3/00 84/319

* cited by examiner

MUSICAL INSTRUMENT SLIDE AND METHOD OF MANUFACTURE

FIELD OF THE DISCLOSURE

This disclosure relates to musical instrument slides and methods of manufacture, and more particularly to a musical instrument slide for use on a stringed instrument with a slide body and insert being positioned to hold liquid in between. The liquid serves to affect the tone and sound profile and provide the sound emanating from the strings of the musical instrument. The musical instrument slide and method of manufacture may include the ability to remove and replace the liquid within the slide device to further selectively modify the sound emanating when the slide is applied to the strings of the instrument. Furthermore, a sealing member is included to allow the opening, closing and sealing of the musical instrument slide to remove, replace and otherwise change the liquid and subsequently hold the liquid within the interior of the musical instrument slide device without leaking.

BACKGROUND OF THE DISCLOSURE

Live musical performances provide sound or audible experiences to the performer and to the audience. Performers often enhance the audio profiles and tones of their live performance with special effects. Such sound effects produced by musical instruments have become especially common with the use of electrically amplified instruments, such as electric guitars, slide guitars, pedal guitars, banjos, violins and the like.

Musical instrument players, primarily stringed instrument players including most prominently, guitarists, have deployed and incorporated the use of what is commonly known as a slide. Use of a slide during playing has developed slide techniques that evolved from specific styles inspired from blues, folk, country and rock music. Guitarists and other string instrument players have included these various slide styles in playing for generations. In this slide style of playing, a guitar slide is used to contact the strings along the neck of the stringed instrument, such as the guitar, with one hand while the strings are being picked or strummed over the guitar body, or the pickups of an electric guitar.

Common guitar slides comprise a tube or cylindrical body portion with a hollow interior that is received over one of the fingers of a musician's hand that holds the guitar neck. Slide style playing first started with the use of a glass pill bottle, glass beer bottle or alternatively using the detached neck portion of a glass wine bottle directly applied to the stringed instrument to produce note tones. The guitar slide is most often moved either slowly or quickly along the neck toward or away from the guitar body to change the sounds, as desired. Musicians are often recognized for the tone quality and uniqueness of the notes they are able to produce from their instrument, thus the quest for producing a slide that offers such a distinct and unique tone has continued through different designs, models, materials and combinations, but all such attempts have yielded results that have been marginal at best. This is due in part that such attempts have been based on the same shared original basic design principal.

It has been determined that a liquid filled glass slide produces an improved and unique tonal profile and note sounding. This new and original design and method of manufacture not only allow for creating different sounds, tonal profiles and textures, but the design incorporates an added ability to vary and change the note tone by providing for changing the liquid or fluid and its composition within the walls of the slide. It has been determined that a preferred material is a slide made essentially from glass. Therefore, a need exists for a stringed instrument or guitar slide and method of manufacture which includes a hollow glass walled structure with the ability to fill the space between the glass walls with a preferred liquid or fluid. The ability to fill and change the liquid or fluid allows adjustment to the tone of the string being played to the desired tonal profile, tone type, wave shape and quality for a particular musician's style or particular sound profile that the musician desires to achieve on stage or in the studio. It is also desirable that the new slide device and method of manufacture provide the comfort and ease of use required for the musician while playing. It is this ability to change the tone of the slide and find that right mix for a particular style of slide playing that is important to the stringed instrument player and guitarist.

SUMMARY OF THE DISCLOSURE

The present disclosure is directed to a musical instrument slide for a stringed instrument comprising a slide body defining an outer wall, the outer wall configured to affect sound produced by the instrument when applied to one or more strings of the instrument. The musical instrument slide also includes an insert within the slide body defining an inner wall and creating a space between the slide body and the insert. The musical instrument slide further includes liquid within the space between the slide body and the insert to further affect the sound produced by the instrument when the outer wall is applied to the strings of the musical instrument.

The slide body can be made of any rigid material, but preferably is made of glass through which light may pass. When the guitar is played by the musician, the vibrations of the slide against the guitar string along the neck produces unique sounds which are enhanced and modified by the liquid within the musical instrument slide device.

Another embodiment of the present musical instrument slide is directed to a slide having generally elongated slide body. A further embodiment of the musical instrument slide includes a slide body and the insert each having an opening and forms an internal space sized to receive a finger of a musician for selective manual application of the outer wall of the slide body to strings of the instrument. Another embodiment of the disclosure includes a musical instrument slide where the slide body defines an inner wall and includes a spacer element formed therein or the insert defines an outer wall and a spacer element formed therein or a combination of the spacer element formed on both the slide body and the insert or a spacer positioned there between.

The musical instrument slide may also include the insert being received by the slide body and engaging the spacer element defining the space between the slide body and the insert. A further embodiment of the musical instrument slide device includes the space between the slide body and the insert being filled with liquid. The liquid may include water, a combination of water and alcohol, combination of water and isopropanol, a combination of water and wetting agents, a combination of water, isopropanol and ethylene glycol or a combination of water, cleaning agents and wetting agents.

The musical instrument slide may also include a collar positioned around the opening of the slide body which may seal the liquid within the space between the slide body and the insert. Liquid may be selectively sealed between the slide body and the insert and be changed as required by removing the collar. The musical instrument slide may also include a collar positioned around the opening of the slide body to secure the players finger within the space about the opening of the slide. Different sized collars may be provided to accommodate different sized fingers of various players. An additional embodiment of the musical instrument slide may also include a slide body and insert which are substantially transparent or translucent.

The method of manufacturing a musical instrument slide of the present disclosure includes the steps of forming a slide body consisting essentially of glass which defines an outer wall and an opening at one end with a rim, the outer wall configured to affect sound produced by the instrument when applied to one or more strings of the instrument and forming an insert consisting essentially of glass which defines an inner wall and an opening at one end with a rim. The method of manufacture also includes the step of placing the insert within the slide body and creating a space between the slide body and the insert, placing liquid within the space between the slide body and the insert and sealing the space between the slide body and the insert. The method of manufacturing a musical instrument slide includes the step of placing the insert within the slide body and placing a spacer element between the slide body and the insert to maintain the space between the slide body and the insert.

The method of manufacturing a musical instrument slide also includes the step of placing liquid within the space between the slide body and placing a combination of water and isopropanol within the space between the slide body and insert. The method of manufacturing a musical instrument slide also includes the step of sealing the space between the slide body and placing a collar on the rim of the slide body and the rim of the insert thereby sealing the space in between. The method of manufacturing a musical instrument slide also includes placing a collar having an aperture or opening positioned around the opening of the slide body to secure the players finger within the space about the opening of the slide. The method of manufacturing a musical instrument slide also includes providing collars having a variety of aperture or opening sizes to accommodate different sized fingers of various players. The method of manufacturing a musical instrument slide also includes providing a collar with an opening to engage and accommodate different sized fingers of various players. The opening of the collar can be of a variable size. Such a variable sized collar can include flexible flaps to engage and position the player's finger in the slide for control and playability.

DESCRIPTION OF THE DRAWINGS

These and other features, aspects, and advantages of the present disclosure will become better understood and appreciated by reference to the following detailed description of the invention, taken in conjunction with the accompanying drawings and appended claims wherein:

FIG. 7 is a side perspective view of another embodiment of the musical instrument slide of the disclosure, showing liquid between the slide body and insert sealed by a glass rim there between.

DETAILED DESCRIPTION

Figure 1:
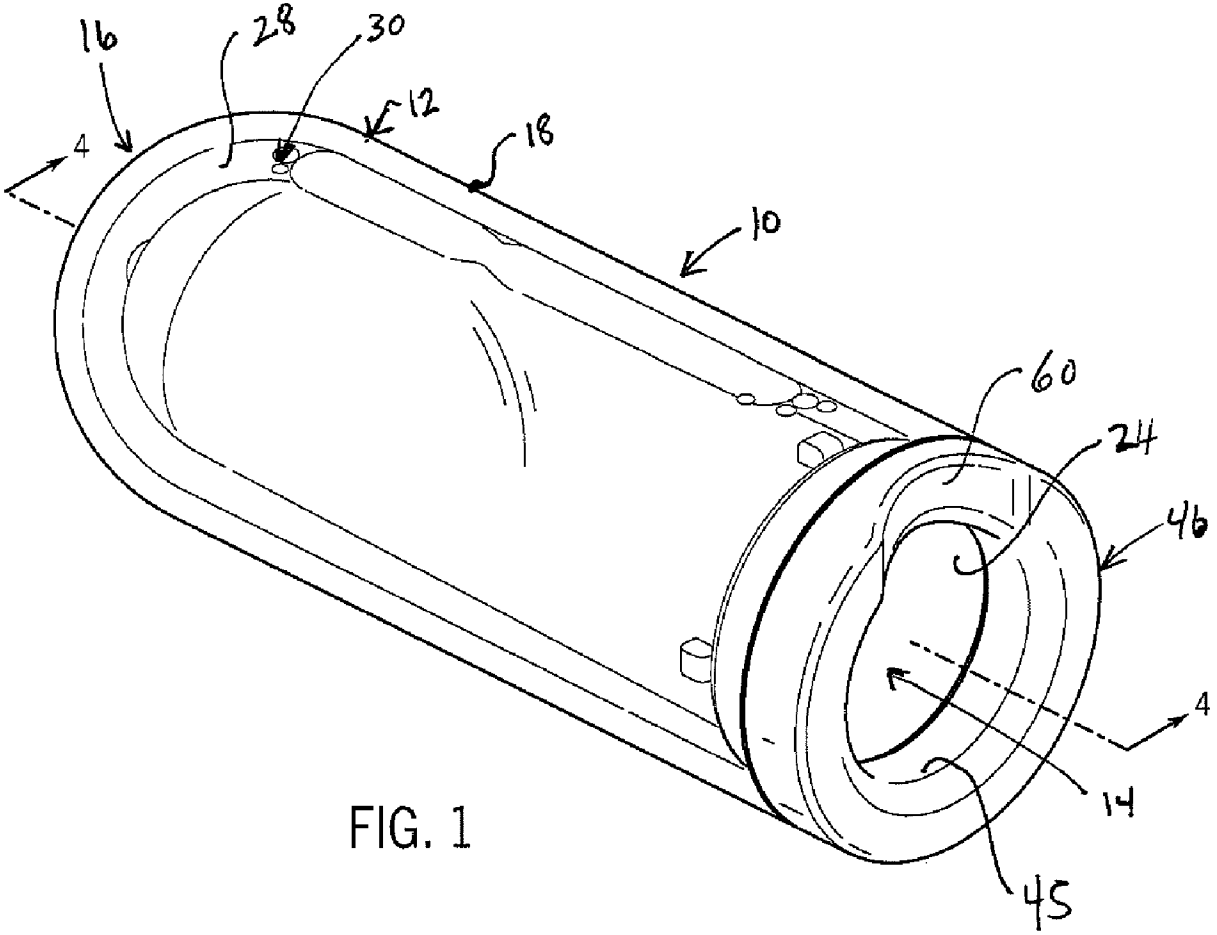
FIG. 1 is a side perspective view of an embodiment of the musical instrument slide of the disclosure, showing liquid sealed between the slide body and insert with a sealing collar.
Figure 2:
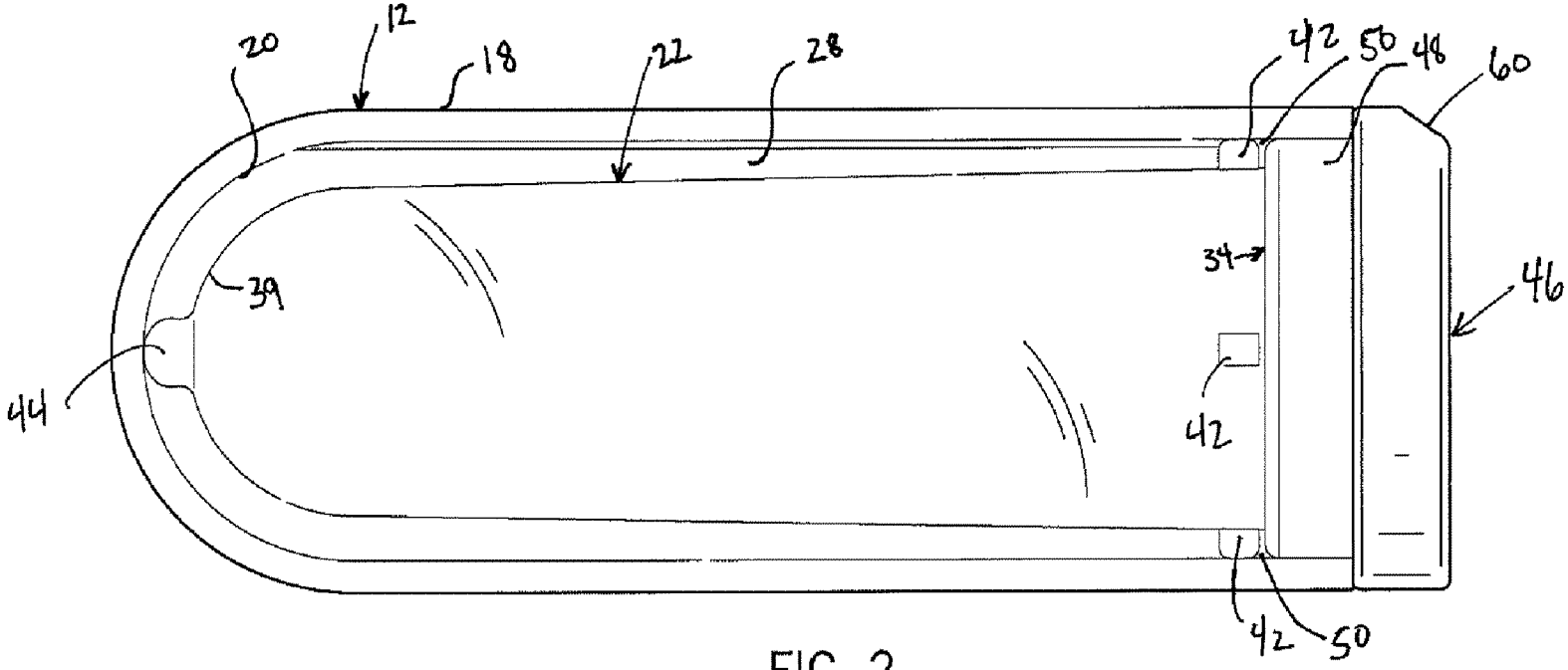
FIG. 2 is a side plan view of the musical instrument slide of FIG. 1.

A musical instrument slide 10, constructed according to the present embodiment, includes a generally tubular body 12. The body 12 has a first open finger-receiving end 14 and a second end 16. The second end 16 is preferably closed as in the illustrated embodiment. The body 12 has a generally tubular shape. The body 12 has an outer surface or wall 18 and an inner surface or wall 20. The outer wall 18 and the inner wall 20 may taper from first finger receiving end 14 to the second end 16. Those skilled in the art may vary this angle for particular finger fits.

It will be appreciated by those skilled in the art that the thickness of the wall of body 12 may vary based on a particular application for achieving a particular sound profile or to accommodate the size of a finger of a particular user.

One embodiment of the musical instrument slide 10 for a stringed instrument as illustrated in FIG. 1 includes slide body 12 defining outer wall 18 which when engaged with the strings of the instrument provide the sound desired by the musician. Slide 10 also includes an insert 22 which may be inserted within slide body 12. Insert 22 includes an inner wall 24 and an outer wall 26. Upon insertion of insert 22 into body 12, a space 28 is created between slide body 12 and insert 22. As shown in the embodiment of FIG. 1 the space 28 is formed between inner wall 20 of slide body 12 and the outer wall 26 of insert 22. As illustrated in FIG. 1, space 28 is filled with liquid 30 upon insert 22 being positioned within slide body 12. Placing liquid 30 within space 28 further affects and enhances the sound produced by the musical instrument when slide body outer wall 12 is applied to the strings of the instrument.

As can be seen in FIGS. 1-8, musical instrument slide 10 including slide body 12 is generally elongated. Insert 22 may also be elongated or other may be shaped in other forms to fit within slide body 12 to provide alternate sounds as desired by the musician or the listener. Such possible shapes may be tubular, plug like, a simple seal or other desired shape to engage with and contain liquid 30 placed within slide body 12.

Figure 3:
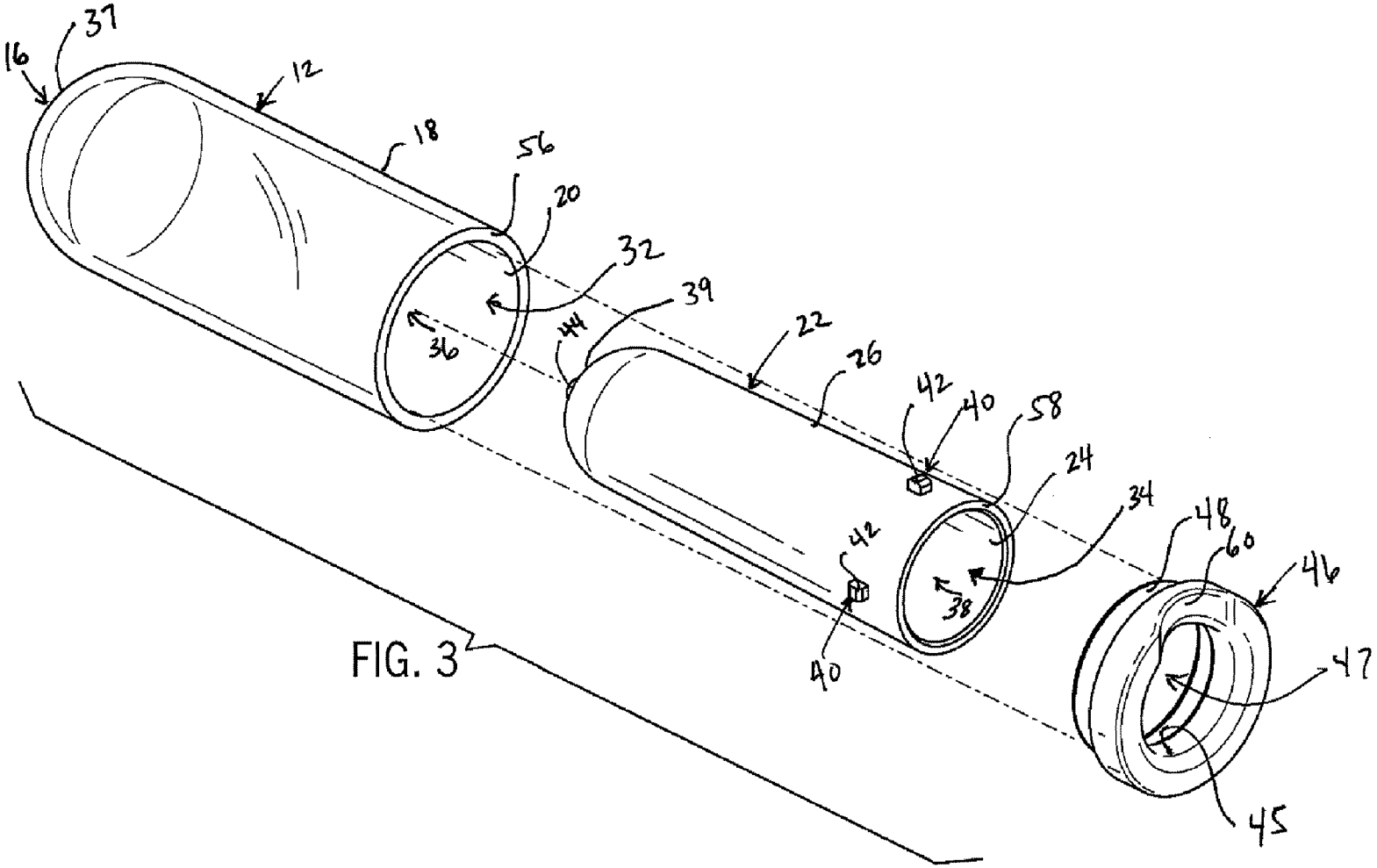
FIG. 3 is an exploded view of the musical instrument slide of FIG. 1.
Figure 4:
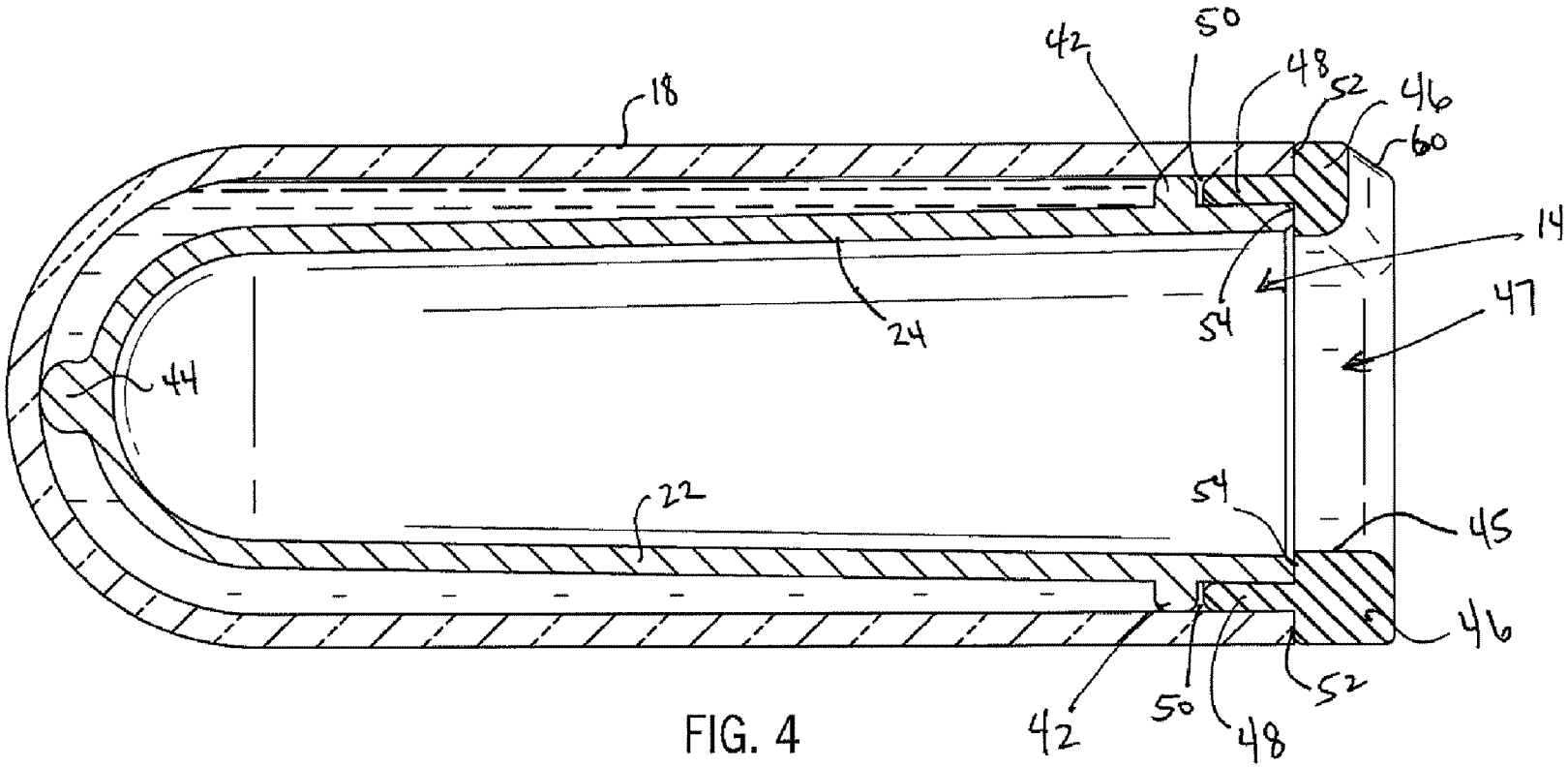
FIG. 4 is a cross-sectional view along line 4-4 of the musical instrument slide of FIG. 1.

As illustrated in FIGS. 3 and 4, slide body 12 and insert 22 each include an opening 32, 34 forming an internal space 36, 38 in each, respectively and a domed second end 37, 39 in each. Internal space 36, 38 individually or in combination are sized to receive a finger of a musician for selective manual application of outer wall 18 of slide body 12 to strings of the instrument.

Figure 5:
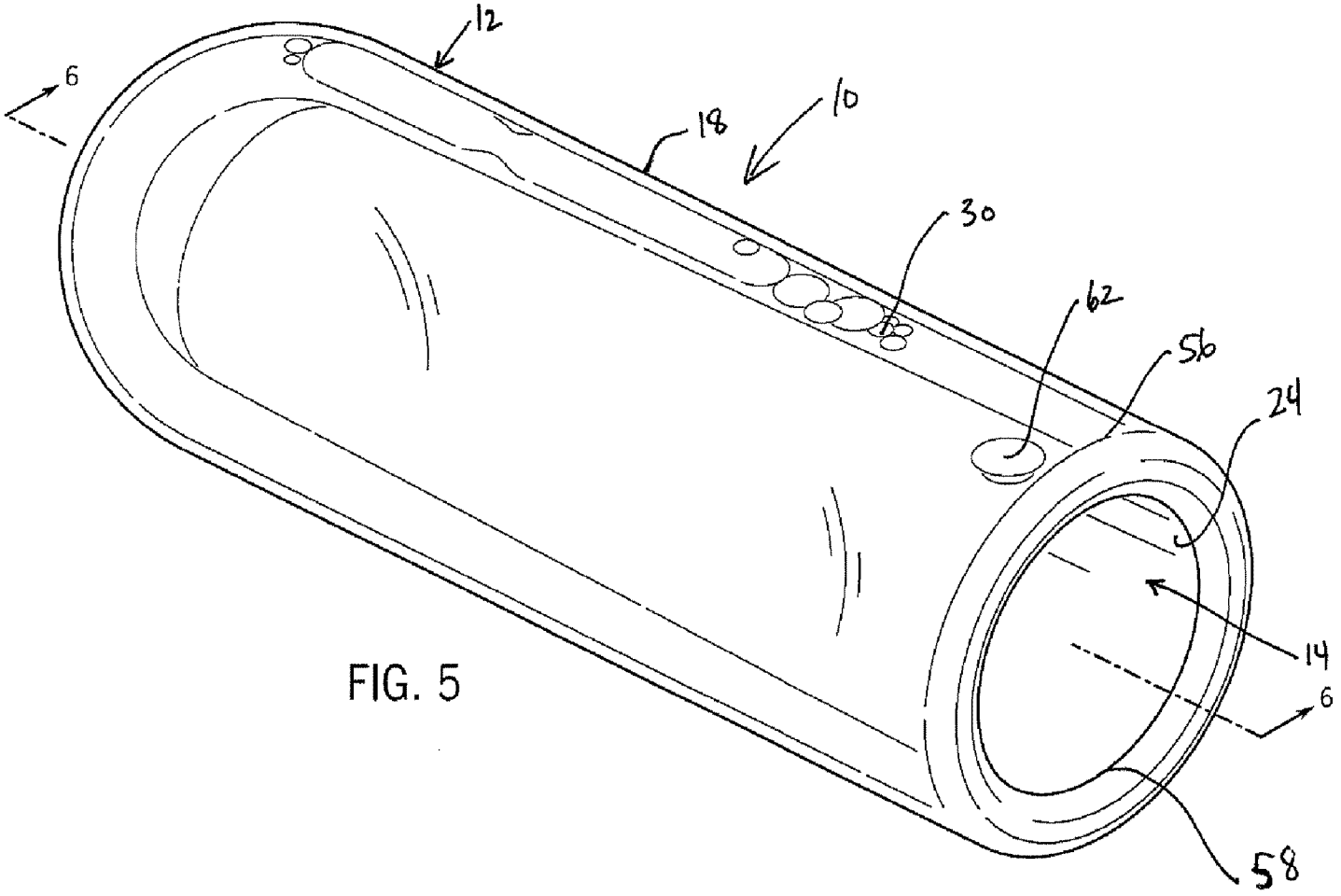
FIG. 5 is a side perspective view of another embodiment of the musical instrument slide of the disclosure, showing liquid sealed between the slide body and insert with a sealing plug.
Figure 6:
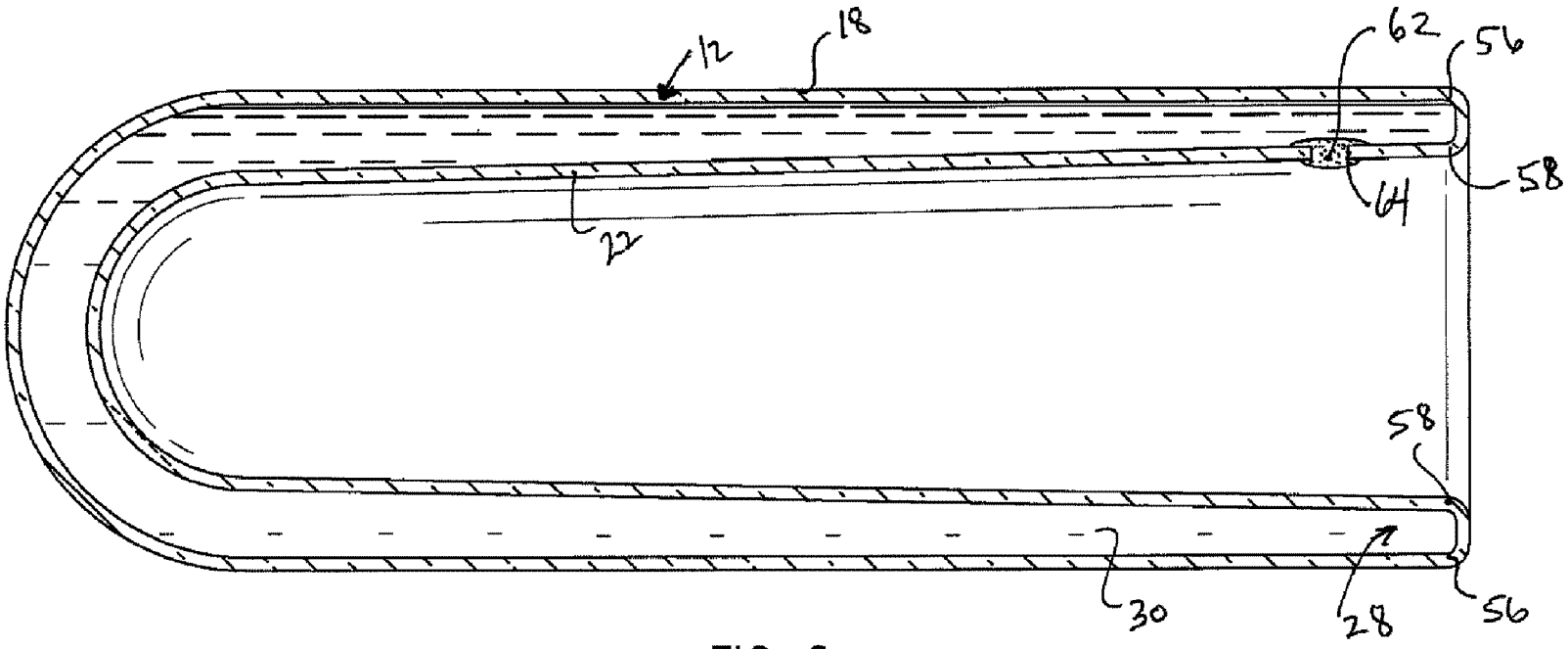
FIG. 6 is a cross-sectional view along line 6-6 of the musical instrument slide of FIG. 5.
Figure 7:
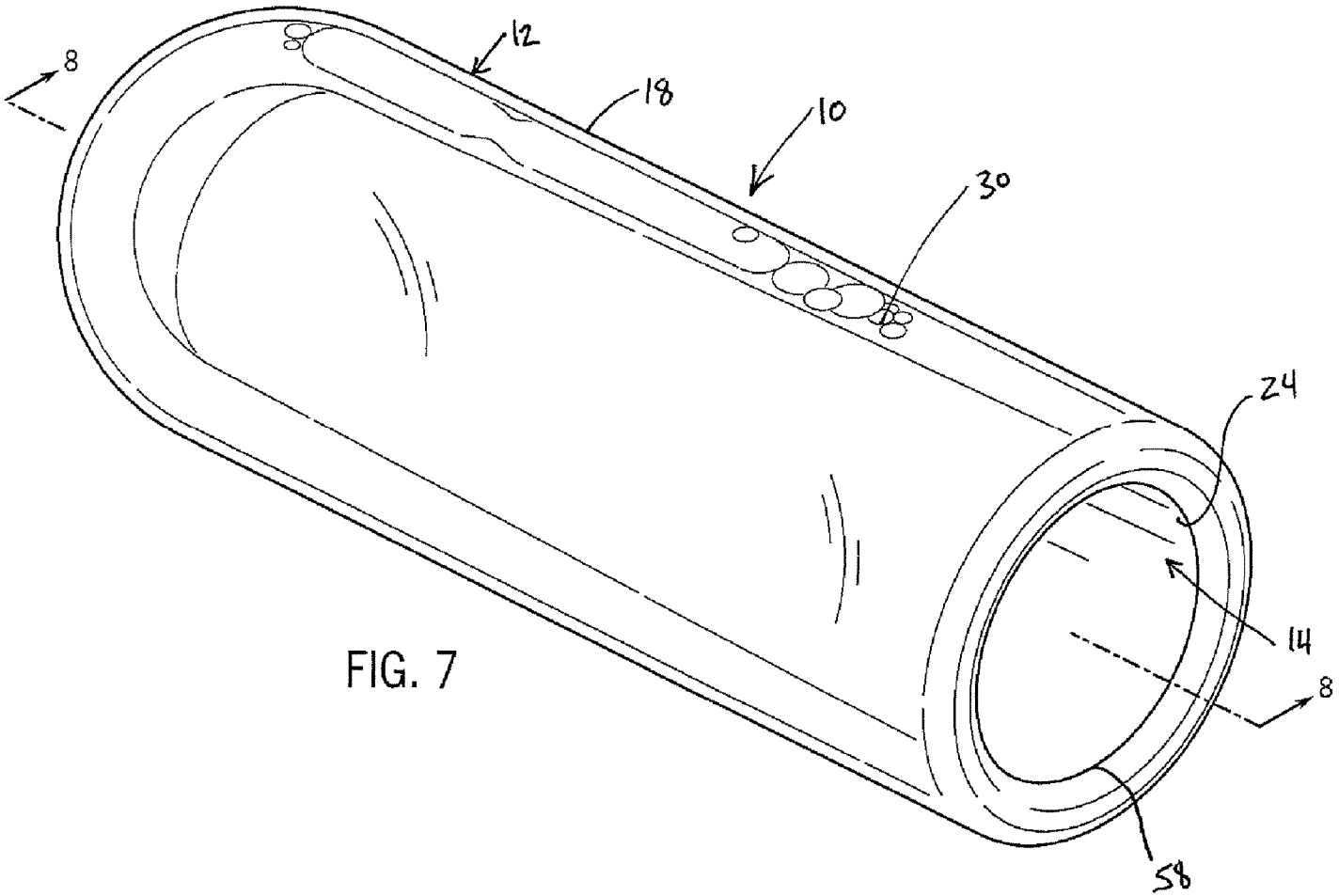
Figure 8:
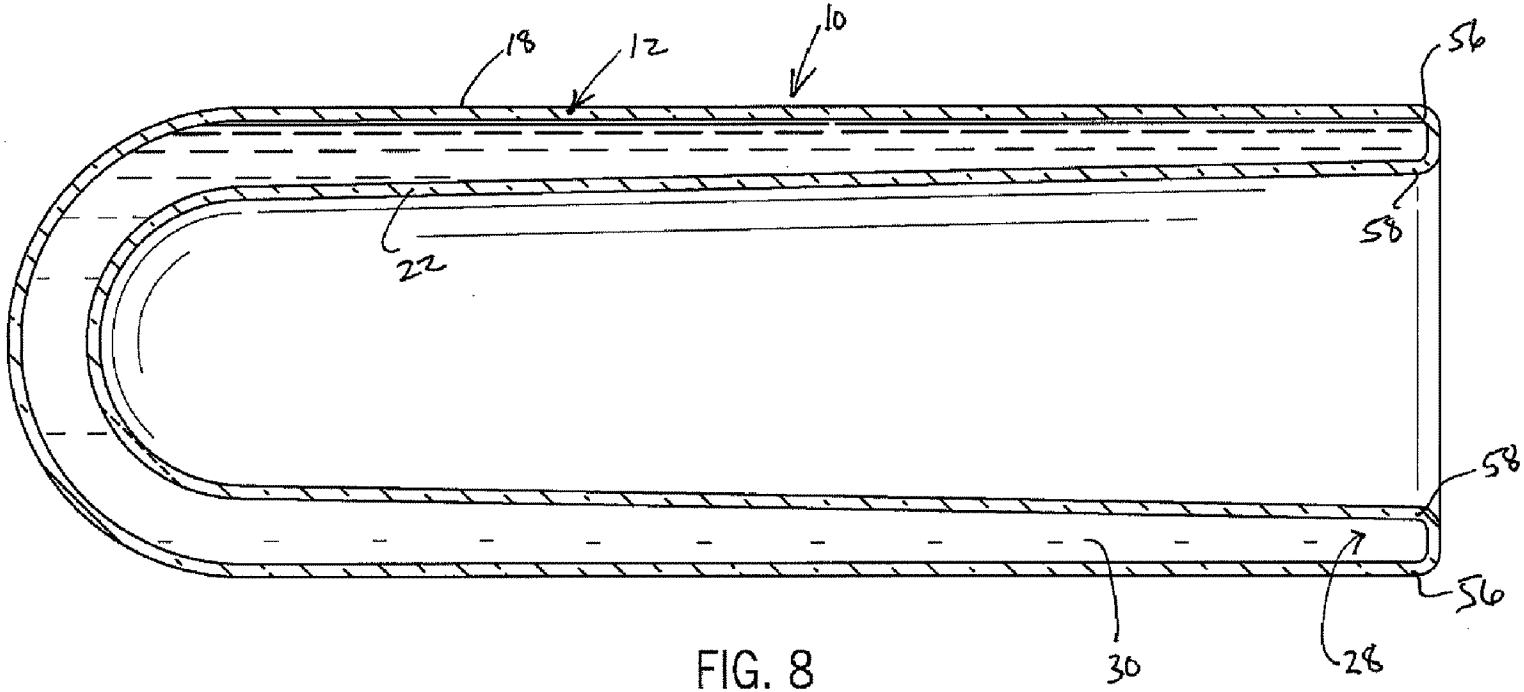
FIG. 8 is a cross-sectional view along line 8-8 of the musical instrument slide of FIG. 7.

FIGS. 4, 6, and 8 are cross-sectional views taken along line 4-4 of FIG. 1, Line 6-6 pf FIG. 5, and line 8-8 of FIG. 7. As can be seen in FIGS. 2, 4, 6 and 8, insert 22 is formed with a taper which becomes smaller from its open end 34 to closed end 39. The taper provides for a proper fit on the finger of the musician to allow the needed control of musical instrument slide 10 when engaging the strings of the musical instrument. The opening 34 of insert 22 may be sized for various users. Common diameters of opening 34 of insert 22 can be 0.6875", 0.750", 0.8125", 0.875", 0.9375", 1" and others based on the size of the musicians playing finger. Common diameters near the closed end of insert 22 may include 0.6750", 0.725", 0.800", 0.850", 0.9125", 0.9250"" and others based on the size of the musicians playing finger. Such taper determines the size of space 28 between slide body 12 and insert 22 and the tonal quality of the notes played by the musician.

As illustrated in the embodiment shown in FIGS. 1-4, musical instrument slide 12 includes a spacer element 40 on slide body 12 inner wall 20. Spacer element 40 may include tabs 42 as shown in FIGS. 1-4 or other protrusions, nibs, glass ledges, formations or the like. As can be seen in the embodiment shown in FIGS. 1-4, insert 22 is received by slide body 12 and includes tabs 42 forming spacer element 40 which include tabs 42 and end stop 44, all of which assist in defining the space between slide body 12 and the insert 22.

As will be appreciated by those skilled in the art, spacer element 40, including tabs 42 and or end stop 44 may be positioned on insert 22 as shown in FIGS. 1-4 or on slide body 12. Alternatively, spacer element 40, which may include tabs 42 and end stop 44 or alternative spacing elements can be positioned on one or both of slide body 12 and insert 22 to provide the space necessary to fill the space between slide body 12 and insert 22 with liquid 30. Such alternative spacer element combinations may also be chosen based on the sound profile, frequency, tone or enhancement desired by the musician or the listener.

Musical instrument slide 10 is filled with liquid to obtain the desired tones when the outer wall 18 of musical instrument slide body 12 of slide 10 is engaged with the strings of a musical instrument. As set forth above, space 28 is formed between slide body 12 and insert 22 when insert 22 is positioned within slide body 12. Spacer elements 40 maintain the space 28 between slide body 12 and insert 22 upon installing insert 22 within slide body 12.

As can also be seen in FIGS. 1-4, space 28 between slide body 12 and insert 22 is sealed through a sealing mechanism. In one embodiment, such a sealing mechanism includes a collar 46 with an opening 47 which is positioned around openings 32, 34 of slide body 12 and insert 22, respectively. Opening 47 may be sized to accommodate various sized fingers based on the particular musician's needs (See FIG. 4A).

As can be seen in FIG. 4, collar 46 fits around the outside circumference of opening 34 of insert 22. As can be seen in FIGS. 3 and 4, collar 46 includes sealing lip 48 which is positioned within opening 50 filling and sealing the space of opening 50 between slide body 12 and insert 22. In this embodiment, collar 46 and sealing lip 48 seal liquid 30 within space 28 between slide body 12 and insert 22. As shown in FIG. 4, collar 46 includes abutment surfaces 52, 54 on either side of sealing lip 48 which engage the rims or top edge surfaces 56, 58 of slide body 12 and insert 22, respectively.

Collar 46 may also include a finger rest which, as illustrated in the embodiment of FIGS. 1-4, is a semi-circle formation 60 on the top of collar 46. Opening 47 accepts the finger of the musician and semi-circle formation 60 provides a comfortable rest for the finger of the musician, particularly when the musicians finger is inserted within insert 22 of musical instrument slide 10 and applied to the strings of the musical instrument to play the strings and enhance the tonal profile of the stringed instrument. Collar 46 allows the musician to comfortably and freely move the finger and slide combination to accurately play the strings of the musical instrument. It may be appreciated that the radius of semi-circular formation 60 can vary to accommodate different finger sizes of the musicians using the stringed instrument slide 10. It may be appreciated by those skilled in the art that the formation for inserting a musician's finger may be of any shape that allows the musicians finger to rest on collar 46, provide comfort to the musician and provide control of slide 10 during wearing of the slide and the playing of the musician's instrument.

Collar 46 may be formed from a solid piece of rubber, plastic or other similar flexible materials to provide a seal for the liquid contained in the musical instrument slide 10, as well as provide a comfortable rest and control point for the finger of the musician using slide 10 to play the stringed instrument. Collar 46 may be sized to accommodate various finger diameters to provide alternatives for a wide variety of musicians to use slide 10. Collar 46 includes opening 47. Opening 47 may be sized as necessary to accommodate a variety of finger sizes presented by the wide variety of musicians using slide 10.

Figure 4A:
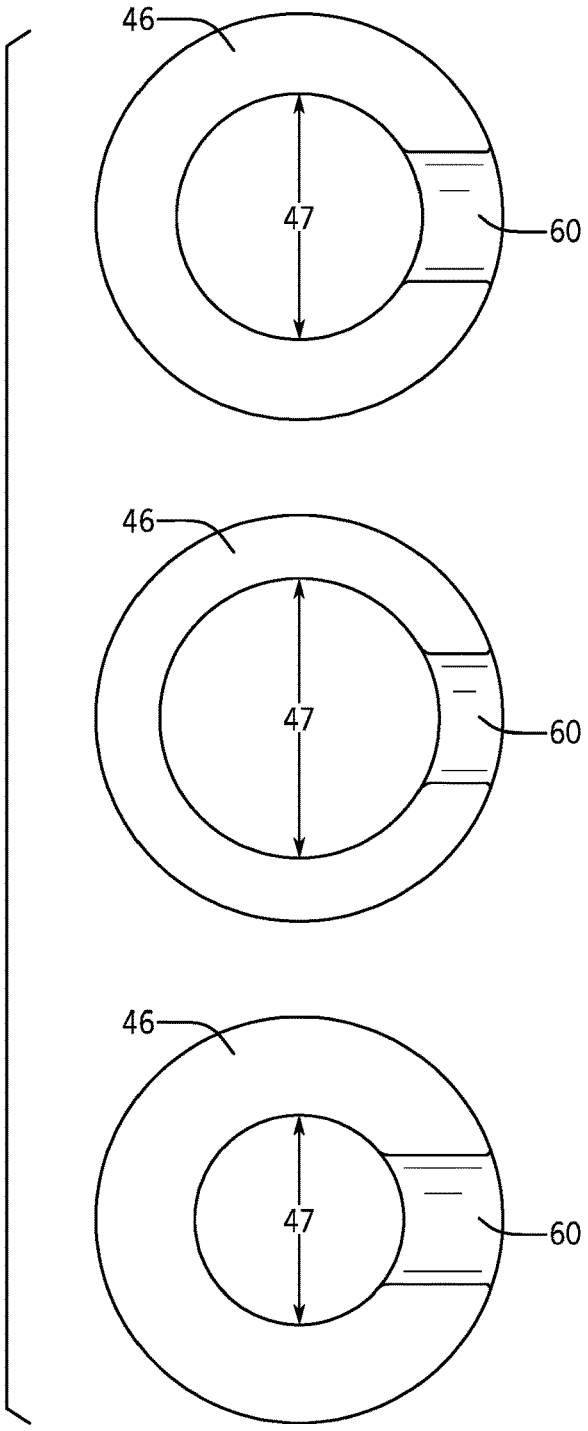
FIG. 4A is a view the collar showing various sized apertures or openings therein.
Figure 4B:
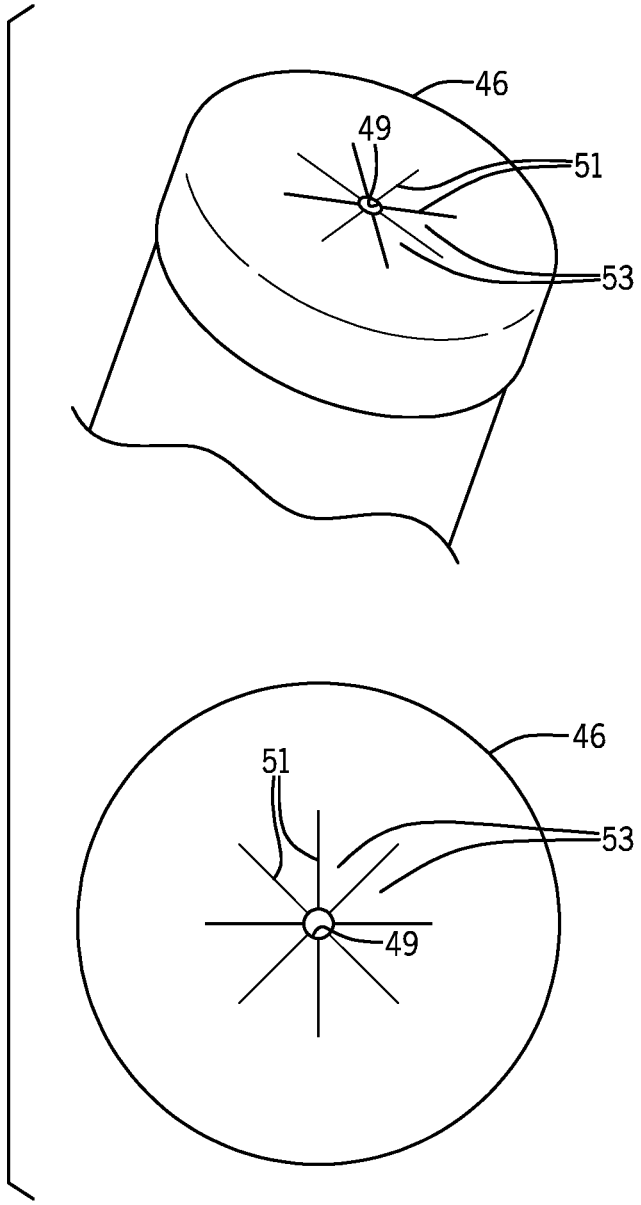
FIG. 4B is a view of the collar showing flexible flaps controlling the size of the aperture or opening to the musical instrument slide.

In an alternative embodiment as shown in FIGS. 4A and 4B, collar 46 may include aperture or opening 47 which may be of various sizes. Opening 47 can be of a certain desired fixed size which may vary based on having multiple collars available for players of different sizes for placement on slide 10. Collar 46 can be removable from slide body 12 as desired.

In yet another alternative embodiment, as shown in FIG. 4B, collar 46 may include one or more slits 51 forming flaps 53. Flaps 53 can be flexible to accept insertion of the player's finger. An aperture or opening 49 is formed defining the free end of multiple flaps formed in collar 46. As a player's finger is moved into opening 49, slits 51 are forced apart and widen separating flaps 53 to grasp the player's finger holding it securely within the opening 49 of slide 10. Flaps 53 can be released through friction or through movement of one flap to allow the player's finger to disengage, be released and moved out of the opening 49 and removed from slide 10. After the player's finger has passed through the slits 51, flaps 53 move back into engagement with the player's finger due to their own inherent resiliency. After the player's finger has been removed from opening 49, flaps 53 move back into abutment with one another due to their own inherent resiliency. Such an alternative embodiment provides a variable sized opening to accommodate different sized fingers of various players of the stringed musical instrument.

It may be appreciated that collar 46 may be included without sealing slide 10. Collar 46 can be removable and positioned around openings 32, 34 of slide body 12 and insert 22 to allow use by players with different sized fingers, as described above. In addition, the various collar designs may also provide sealing of the space 28 between slide body 12 and insert 22 as necessary. Various elements as described herein can be combined as preferred to provide the slide best suited for a particular player, a particular style or particular sound desired by the player or audio engineer.

In one alternative embodiment shown in FIGS. 5 and 6 and a second alternative embodiment shown in FIGS. 7 and 8, the top edge surface 56 of slide body 12 and top edge surface 58 of insert 22 are sealed by a glass edge formed between top edge surfaces 56, 58. In the embodiment of FIGS. 5 and 6, a filler plug 62 is included within an opening 64 in slide body 12. It will be appreciated that opening 64 may be placed as necessary within the outer wall 18 of slide body 12, or at any accessible location with the inner wall 26 of insert 22. Filler plug 62 is removable such that liquid can be injected, poured or otherwise placed in space 28 between slide body 12 and insert 22. The embodiments of FIGS. 1-4 and 5 and 6 each include the ability to easily remove and change liquid placed within space 28.

In the second alternative embodiment of FIGS. 7 and 8, musical instrument slide 12 can be formed from glass with liquid 30 placed with space 28 between slide body 12 and insert 22 at the time of manufacture. This embodiment provides for a fully sealed musical instrument slide 10 with a chosen liquid 30 sealed between slide body 12 and insert 22 within space 28. In this alternative embodiment, spacer element 40 can be eliminated, providing further enhanced and alternative sound profiles which may be produced by musical instrument slide 10.

It has been determined that various combinations of liquids can provide desired sound quality and tone profiles based on musician and player preference. Such liquid combinations may include water and alcohol; water and isopropanol; water, isopropanol and ethylene glycol; water and wetting agents; water, cleaning agents and wetting agents, various water and alcohol combinations including commonly available solutions such as Windex® and other glass cleaners, cleaning solutions and the like, all providing different tonal qualities and profiles, as desired by a particular musician, listener, recording engineer, mixing technician or similar sound professional or producer.

Slide body 12 and insert 22 made be formed from various materials which can further enhance, modify or affect the tone profile produced by the musical instrument slide 10 when engaged with the strings of the musical instrument, guitar, violin, viola, or other stringed instrument. One preferred material that has provided a preferred tonal profile includes glass in various formulations. It is also preferred that the material be substantially transparent or translucent to enhance the visual appearance of musical instrument slide. If may also be preferred to place artistic designs on various portions of the musical instrument slide 10 to increase the desirability and collectability of slide 12.

A method of manufacturing a musical instrument slide is also provided. One embodiment of the method of manufacturing includes forming a slide body 12 consisting essentially of glass which defines an outer wall 18 and an opening 32 at one end with top edge surface 56. Outer wall 18 is configured to affect sound produced by the musical instrument when applied to one or more strings of an instrument. The method also includes forming an insert such as insert 22 consisting essentially of glass which defines an inner wall 24 and an opening 34 at one end with top edge surface 58. The method further includes placing insert 22 within the slide body and creating a space 28 between slide body 12 and insert 22. Liquid is placed within space 28 between slide body 12 and insert 22. Space 28 between slide boy 12 and insert 22 is sealed to contain liquid 30 therein.

The method of manufacturing a musical instrument slide also includes the step of placing insert 22 within slide body 12 and placing spacer element 40 between slide body 12 and insert 22 to maintain space 28 between slide body 12 and insert 22. The method of manufacturing a musical instrument slide also includes the step of placing a combination of water and isopropanol within space 28 between slide body 12 and insert 22. The method of manufacturing a musical instrument slide further includes the step of sealing space 28 between slide body 12 and the insert and placing a collar such as collar 46 on the rim 56 of slide body 12 and rim 58 of insert 22 thereby sealing space 28 between slide body 12 and insert 22.

It may be appreciated by those skilled in the art that the liquid used to be placed within space 28 may include liquids consisting of a combination of water, propan-2-ol, 2-Propanol, isopropanol, rubbing alcohol, sec-Propyl, alcohol, s-Propanol, iPrOH, i-PrOH, Dimethyl carbinol, IPA, 1-Propanol, ethanol, 2-butanol or the like. In addition, it is desirable that such combinations include components that are miscible in water. It is desirable that all such combinations include components wherein the property of the combination of liquid substances can mix in all proportions which allows the liquids to fully dissolve in each other at any concentration, forming a homogeneous solution. It is also desirable that such liquids have physical and chemical properties to form a supersaturated layer of vapor which can be condensed by particles of radiation, particularly under gamma rays, X-rays and the higher energy range of ultraviolet light to provide ionization in the electromagnetic spectrum of the ultraviolet spectrum. Such characteristics have been found to provide the desired sound characteristics and tonal profile most desired by musicians and listeners. It is particularly desirable to use a liquid that has the proportions of water by weight of 60% to 99% and Isopropanol by weight of 1% to 5%. It may also be desirable to include ethylene glycol or ethylene glycol monohexylether of 0.01% to 1% to enhance the sound profile and tonal characteristics of the liquid filled musical instrument slide 12. Desirable ph ranges of such a preferred liquid combination is between 10.5-11.0 with a flash point of 130-185 degrees Fahrenheit or 54-85 degrees Celsius and specific gravity of approximately 1.0 with a density of approximately 0.997 g/cm$^3$ at approximately 20 degrees Celsius.

Mode of Operation

The interior of the guitar slide 10 accommodates a finger of the musician's hand through finger receiving end 14. Downward fretting pressure is applied to guitar slide 10 to simultaneously depress the strings of the fretted stringed instrument, which includes electric guitars, steel guitars, acoustic guitars, bass guitars, violins, banjos, and other stringed instrument adjacent to a fret on the neck of the stringed instrument.

Often, individual notes are required to be played. For individual note playing, the outer surface 18 of slide body 12 is brought into contact with an individual string adjacent to an appropriate fret by tipping the cording hand finger upwardly.

Referring in generally to FIGS. 1 through 4, a musical instrument slide 10 constructed in accordance with the disclosure herein is illustrated. The musical instrument slide 10 includes a cylindrical body 12 defining an internal cavity at the opening 34 of insert 22. The cavity is defined by a very gradually tapered inner Surface 25 which results in frictional connection with the musician's finger.

Opening 34 is reduced in diameter by collar 46 having an annular inner surface 45 with a diameter smaller than the tapered inner Surface 24 of insert 22. Inner surface 45 tends to grip the tip of the musician's finger when the finger is gently forced toward domed end 16.

A finger rest on the top of collar 46 includes a semi-circle formation 60 which allows the finger carried within slide 10 to stabilize slide 10 during use. Collar 46 may provide a seal for space 28 between insert 22 and slide body 12, if necessary. Collar 46 may also just provide a frictional insert to fit the various sizes of player's fingers to allow comfortable positioning, frictional engagement and player control of the slide as described herein.

Referring to FIGS. 5-8, a cylindrical body 12 and insert 22 together provide a hollow interior of slide 10, defining a cavity beginning at 21. When worn by the musician, the tip of the musician's finger is carried within the forward end 22 of the cylindrical body, and the base of the musician's finger is carried within the rearward end 23 of the cylindrical body. The musicians finger cavity is sized to allow the musician to fit a single finger within the cavity, and for the slide to become attached to the finger due to frictional contact between the two. Due to the differences in the size of different musician's fingers, the overall size of the guitar slide adapted for any specific user may vary somewhat. As a result, by firmly inserting one finger, the musician is assured of a firm grip on the guitar slide 10.

During use, the outer surface 18 of the cylindrical body may be used to contact the strings of the instrument or guitar in a manner similar to known musical instrument slides.

As seen in FIGS. 5 and 7, a forward opening 14 is defined by rim 58. Rim 58 is an annular surface in a plane perpendicular to the length of the cylindrical body. Rim 58 is adjacent to inner wall 24 of insert 22.

As seen in the cross-sectional view of FIGS. 6 and 8, insert 22 is angled from opening 14 to end 16 providing an interior of insert 22 which narrows from opening 14 to end 16. As a result, when the musician inserts a finger in the cavity, the tip of the musician's finger will tend to become wedged in the area of the interior of insert 22 near end 16. This results in additional stability and control over the slide 10 during use, resulting in easier and more responsive play.

With the first knuckle of a musician's finger fully enclosed within slide 10, the second knuckle is carried within the tapering interior area of insert 22. When the third knuckle is bent, slide 10 can be positioned against the strings of the instrument to provide fretted engagement of slide 10 with the strings.

As can be seen in FIGS. 1-4, one preferred embodiments, includes a finger rest such a semi-circular surface 60. semi-circular surface 60 provides finger engaging semi-circular surface 60 allowing the musician to support and stabilize slide 10 by placing a finger on the finger rest shown as semi-circular surface 60.

Prior to use, the musician typically inserts a finger (usually the second finger, of one hand into opening 14 of insert 22, causing the tip of the second finger to wedge into the annular surface of the interior of insert 22. This positioning causes sufficient friction so as to maintain slide 10 on the musician's finger. The base of the second finger is then placed on the finger rest shown as semi-circular surface 60.

During manipulation as detailed above and during play, the rounded cylindrical outer surface 18 of slide 10 is used to contact the strings of the instrument.

While the principles of the disclosure have been shown and described in connection with the specific embodiments herein, it is to be understood that such embodiments are by way of example only, and are not limiting in any respect.

Reference throughout this specification to "the embodiment," "this embodiment," "the previous embodiment," "one embodiment," "an embodiment," "a preferred embodiment" "another preferred embodiment" or similar language means that a particular feature, structure, or characteristic described in connection with the embodiment is included in at least one embodiment of the present invention. Thus, appearances of the phrases "in the embodiment, "in this embodiment," "in the previous embodiment, in one embodiment, in an embodiment," "in a preferred embodiment," "in another preferred embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention. While the present invention has been described in connection with certain exemplary or specific embodiments, it is to be understood that the invention is not limited to the disclosed embodiments, but, on the contrary, is intended to cover various modifications, alternatives, modifications and equivalent arrangement as will be apparent to those skilled in the art. Any such changes, modifications, alternative, equivalents and the like may be made without departing from the spirit and scope of the disclosure.

The invention claimed is:

1. A musical instrument slide for a stringed instrument comprising:

a. a slide body defining an outer wall, the outer wall configured to affect sound produced by the instrument when applied to one or more strings of the instrument;

b. an insert within the slide body defining an inner wall and creating a space between the slide body and the insert;

c. liquid within the space between the slide body and the insert to further affect the sound produced by the instrument when the outer wall is applied to the strings.

2. The musical instrument slide as claimed in claim 1 wherein the slide body is generally elongated.

3. The musical instrument slide as claimed in claim 2 wherein said slide body and the insert each includes an opening and forms an internal space sized to receive a finger of a musician for selective manual application of the outer wall of the slide body to strings of the instrument.

4. The musical instrument slide as claimed in claim 1 wherein the slide body defines an inner wall and includes a spacer element formed therein.

5. The musical instrument slide as claimed in claim 4 wherein the insert is received by the slide body and engages the spacer element defining the space between the slide body and the insert.

6. The musical instrument slide as claimed in claim 5 wherein the space between the slide body and the insert is filled with liquid.

7. The musical instrument slide as claimed in claim 1 wherein the liquid is water.

8. The musical instrument slide as claimed in claim 1 wherein the liquid is a combination of water and alcohol.

9. The musical instrument slide as claimed in claim 1 wherein the liquid is a combination of water and isopropanol.

10. The musical instrument slide as claimed in claim 1 wherein the liquid is water, isopropanol and ethylene glycol.

11. The musical instrument slide as claimed in claim 1 wherein the liquid is a combination of water and wetting agents.

12. The musical instrument slide as claimed in claim 1 wherein the liquid is a combination of water, cleaning agents and wetting agents.

13. A musical instrument slide as claimed in claim 1 and wherein the insert defines an outer wall and spacer elements formed therein.

14. The musical instrument slide of claim 1 further including a collar positioned around the opening of the slide body to seal the liquid within the space between the slide body and the insert.

15. The musical instrument slide of claim 14 wherein the collar includes an opening which is variable in size.

16. The musical instrument slide of claim 1 and wherein the slide body and the insert are substantially transparent or translucent.

17. A method of manufacturing a musical instrument slide, comprising the steps of:

a. forming a slide body consisting essentially of glass which defines an outer wall and an opening at one end with a rim, the outer wall configured to affect sound produced by the instrument when applied to one or more strings of the instrument;

b. forming an insert consisting essentially of glass which defines an inner wall and an opening at one end with a rim;

c. placing the insert within the slide body and creating a space between the slide body and the insert;

d. placing liquid within the space between the slide body and the insert;

e. sealing the space between the slide body and the insert.

18. The method of manufacturing a musical instrument slide of claim 17, wherein the step of placing the insert within the slide body further comprises placing a spacer element between the slide body and the insert to maintain the space between the slide body and the insert.

19. The method of manufacturing a musical instrument slide of claim 17, wherein the step of placing liquid within the space between the slide body and the insert further comprises placing a combination of water and isopropanol within the space between the slide body and insert.

20. The method of manufacturing a musical instrument slide of claim 17, wherein the step of sealing the space between the slide body and the insert further comprises placing a collar on the rim of the slide body and the rim of the insert thereby sealing the space in between.

* * * * *